US006747639B2

(12) United States Patent
So

(10) Patent No.: US 6,747,639 B2
(45) Date of Patent: Jun. 8, 2004

(54) VOLTAGE-SOURCE THIN FILM TRANSISTOR DRIVER FOR ACTIVE MATRIX DISPLAYS

(75) Inventor: Franky So, San Jose, CA (US)

(73) Assignee: Osram Opto Semiconductors GmbH, Regensburg (DE)

( * ) Notice: Subject to any disclaimer, the term of this patent is extended or adjusted under 35 U.S.C. 154(b) by 120 days.

(21) Appl. No.: 10/034,603

(22) Filed: Dec. 28, 2001

(65) Prior Publication Data

US 2003/0122805 A1 Jul. 3, 2003

(51) Int. Cl.[7] ..... G09G 5/00
(52) U.S. Cl. ..... 345/211; 345/82; 345/208
(58) Field of Search ..... 345/82, 87, 90, 345/92, 94, 99, 95, 208, 211, 212, 213

(56) References Cited

U.S. PATENT DOCUMENTS 4,458,201 A * 7/1984 Koen ..... 323/317
5,471,225 A * 11/1995 Parks ..... 345/98
6,229,508 B1 * 5/2001 Kane ..... 345/82
6,351,078 B1 * 2/2002 Wang et al. ..... 315/169.3
6,522,315 B2 * 2/2003 Ozawa et al. ..... 345/92

FOREIGN PATENT DOCUMENTS

| | | |
|---|---|---|
| EP | 0 845 770 A1 | 6/1998 |
| EP | 0 895 219 A1 | 2/1999 |
| EP | 1 103 946 A2 | 5/2001 |
| WO | WO 01/59800 A1 | 8/2001 |

* cited by examiner

*Primary Examiner*—Kent Chang

(57) ABSTRACT

A driver circuit for an active matrix display is disclosed wherein said driver circuit comprises a first transistor, said first transistor comprising a source, a drain and a gate; a storage capacitor, said storage capacitor comprising a terminal, said terminal connected to one line, said one line comprised of a group of said source and said drain of said first transistor; a second transistor, said second transistor comprising a source, a drain and gate, wherein said gate is connected to said terminal of said storage transistor; wherein said drain and said source of said second transistor are connected to one of group, said group comprising a power source and a pixel element respectively; and further wherein storage capacitor is chargeable to sufficiently high voltage to operate said second transistor in its linear region of operation.

17 Claims, 5 Drawing Sheets

VOLTAGE-SOURCE THIN FILM TRANSISTOR DRIVER FOR ACTIVE MATRIX DISPLAYS

BACKGROUND OF THE INVENTION

Organic light emitting diode (OLED) devices are increasing becoming the display of choice for a wide range of applications. For example, OLED devices are increasingly being used as displays for computers, laptops, personal digital assistance and cellular phones, just to name a few of their ubiquitous applications. Following their example in liquid crystal display technology, there are two main system architectures for OLED displays—passive and active matrix displays. For high resolution passive matrix OLED displays, one row is addressed at a time. For example, in an OLED display with M rows and an average luminance of L, the pixels in the same row will be driven to a peak brightness of M*L. For a 1000 line display, the peak brightness could exceed 200,000 nits and the voltage required to drive the OLED pixels could exceed 20V. Thus, the passive matrix OLED device may become very inefficient and the display power consumption high.

In order to reduce the power consumption of an OLED display, an active matrix scheme may be highly desirable. In this case, every pixel typically has a switch, a memory cell and a power source. When a row of pixels is addressed, the pixel switch is turned on and data is transferred from the display drivers to the pixel memory capacitors. The charge is held in the capacitor until the row is addressed in the next frame cycle. Once the charge is stored in the capacitor, it turns on the power source to drive an OLED pixel and the pixel will remain on until the next address frame cycle.

As a device, an OLED is commonly characterized as a "current device"—as its light output is proportional to its current input. To achieve good control of the luminance uniformity and good control of gray scale across the entire display, a current source is typically used to drive the OLED device. Therefore, the power source used in an active matrix OLED is usually a current source.

One such current source architecture—as is known in the field of active matrix OLED display (AMOLED)—is shown in FIG. 1. The basic scheme in the field of OLED displays is a two transistor circuit with one transistor being a switch for the data and the other one being a current source. FIG. 1 depicts a typical thin film transistor 100 as is known in the art. The data line is connected to the drain (104) of transistor T1 (102) is connected and the select line is connected to the gate (106). The source of T1 is connected to a capacitor $C_S$ (108) and to the gate of transistor T2 (110). The drain of T2 112 is connected to Power and the source of T2 is connected to the pixel area 114.

In operation, T1 is the switching transistor that allows data charges to be stored in the storage capacitor 108. The stored charge in the storage capacitor 108 turns on the current source transistor T2 110. The drain of the current source transistors T2 supplies the current to the pixel 114 whereby the brightness of the pixel is determined by the drain current in the transistor T2. The drain current ($I_D$) of the transistor T2 is controlled by the charge stored at the storage capacitor 108.

FIG. 2 shows the operating characteristics of transistor T2 as a plot of $I_D$ versus $V_{DS}$. A family of curves are shown—with each curve depicting operation at a different $V_{GS}$. As can be seen, dotted line 202 broadly defines two separate operating regions of transistor T2—the "linear region" 204 and the "saturation region" 206, as is well known in the art. To operate transistor T2 as a current source, it is typical to select a $V_{GS1}$ in the saturation region of transistor T2. Once selected, the current is fairly constant and is independent of the value of $V_{DS1}$. To control the luminosity of the pixel, it is again typical to select the $V_{GS}$. As can be seen, with higher values of $V_{GS}$, the greater the amount of $I_D$ flows through the pixel and, hence, increases its light output.

In constructing the circuit of FIG. 1, thin film transistors (TFTs) are typically used to fabricate the pixel power source because of their relatively low cost. TFTs are widely used in AMLCD today in most high resolution flat panel displays. Most of the TFT's used today for AMLCD are made with amorphous silicon (a-Si) because of the low manufacturing cost. However, a-Si TFT has inherently low carrier mobility (~1 $cm^2$/V-s) and the transistor size is relatively large. This limits the resolution of the displays fabricated with a-Si as well as the capability of using it as a current source.

For displays with fine pitch, polycrystalline Si (p-Si) is used for TFT fabrication because the size of the TFTs can significantly reduced. Typically, the electron mobility in p-Si is close to 100 $cm^2$/V-s while the hole mobility is about 50 $cm^2$/V-s. Since current source is used to drive AMOLED displays (and, in particular, those employing OLED pixels), p-Si typically chosen for TFT fabrication because of the high current capability of p-Si. However, there are many issues associated with using p-Si for TFT fabrications—and particularly when used in OLED displays.

For example, since current sources are commonly used to drive the pixel, the current source TFTs need to have a high current capability. Even with p-Si, the transistor size has to be fairly large relative to the pixel size, resulting in low pixel fill factor. As a result, pixels have to be driven at a higher pixel brightness and this reduces the panel power efficiency and device lifetime. In addition to the cost disparity between a-Si and p-Si TFTs, it is desirable to use a-Si for the driver circuitry of an active matrix display.

Second, the pixel power consumption is then equal to $I^*(V_{PIXEL}+V_{DS})$, where $V_{DS}$ is the source-drain terminal voltage across the TFT and $V_{PIXEL}$ is the voltage across the cathode and the anode of the pixel. As noted above, for current-source operation, a TFT is usually operated in its saturation region. Under this operation, $V_{DS}$ can be quite large, typically in the range of 5–7 V for p-Si. On the other hand, $V_{PIXEL}$ is only about 3 V (in particular, for OLED pixels). As a result, over 60% pixel power consumption is due to the TFT circuitry. Thus, it is highly desirable to reduce the power consumption of the TFT circuitry.

Additionally, there is a problem using TFTs for a current source. The current in the TFT current source is determined by the difference between $V_{GS}$ and the threshold voltage of the gate terminal, $V_T$. The threshold voltages in p-Si TFT are typically non-uniform across the display. This non-uniformity has a big impact on the TFT drain current. Typically, $I_D \sim (V_{GS}-V_T)^2$; thus, a small variation in $V_T$ could have a big change in $I_D$. Several alternative approaches have been proposed to use a more complex circuitry (3–5 TFTs) to compensate for the drift in the threshold voltage. This approach increases the process complexity and affects yield. Since more transistors per pixel are used in the display, it further decreases the pixel fill factor, resulting in a display with lower efficiency and poor lifetime.

SUMMARY OF THE INVENTION

One embodiment of the present invention recites a driver circuit for an active matrix display, said driver circuit comprising:

a first transistor, said first transistor comprising a source, a drain and a gate;

a storage capacitor, said storage capacitor comprising a terminal, said terminal connected to one line, said one line comprised of a group of said source and said drain of said first transistor;

a second transistor, said second transistor comprising a source, a drain and gate, wherein said gate is connected to said terminal of said storage transistor;

wherein said drain and said source of said second transistor are connected to one of group, said group comprising a power source and a pixel element respectively; and further wherein storage capacitor is chargeable to sufficiently high voltage to operate said second transistor in its linear region of operation.

DETAILED DESCRIPTION OF THE INVENTION

To alleviate the problems described above, a voltage source is used to drive the pixel instead of a current source. Schematically, the TFT driver circuitry resembles that of FIG. 1. In the case of OLED pixels, only a two-TFT driver circuit is needed instead of a 3–5 TFT circuit configuration as favored by some to compensate for variations in current source. In this case, both TFTs are used for switches—one (T1) for data and the other one (T2) for powering the pixel. As before, the pixel power consumption relationship is given by:

$$P=I^*(V_{PIXEL}+V_{DS})$$

Here, $V_{PIXEL}$ is the voltage across the cathode and the anode terminals of the pixel and $V_{DS}$ is the drain-source voltage of T2.

Figure 3A:
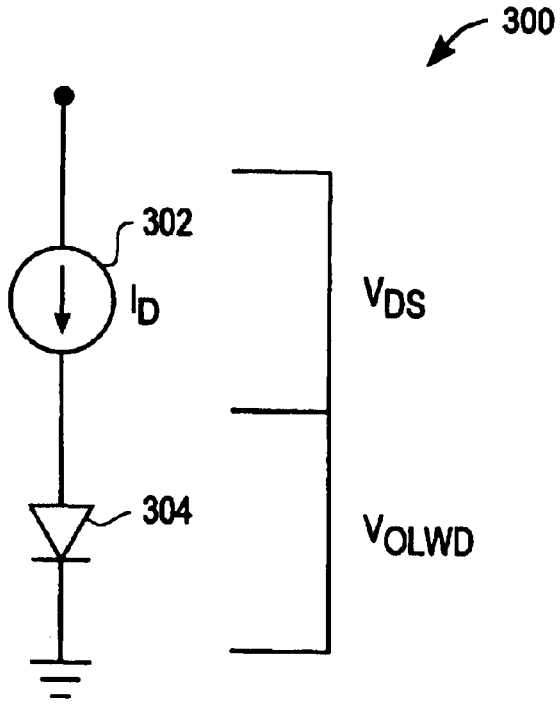
FIGS. 3A–3B show ideal operating characteristics of the transistor working in its saturation region and its linear region respectively.

When T2 is driven in its saturation region, the voltage $V_{DS}$ tends to be high in order to operate as a current source. The idealized form of this circuit 300 is depicted in FIG. 3A. T2, when operating in saturation region, approximated current source 302 placed in series with pixel element 304 (shown as a OLED pixel in the figure). Thus, the total power consumed in this circuit is the product of the current times the total of voltages across the source and drain of T2 and the voltage across the pixel.

Figure 3B:
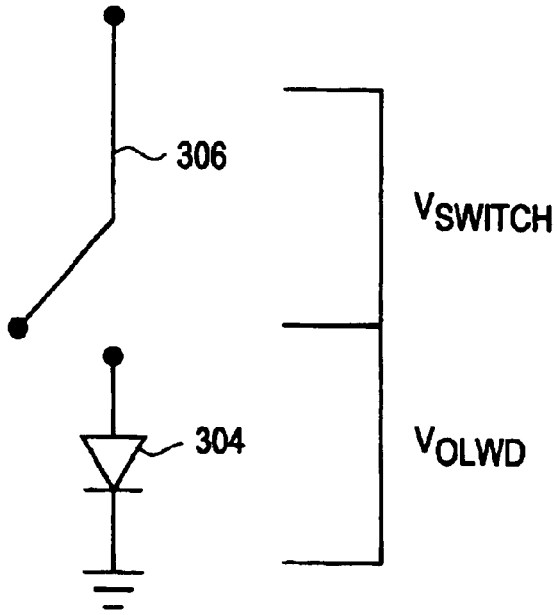

However, when T2 is driven in its linear region, T2 is approximated by a switch as opposed to current source. FIG. 3B depicts the idealized circuit when T2 is driven like a switch 306. Again, using the power consumption relationship, the power still varies as the sum of the total voltage across the switch and the pixel element. However, as the voltage across the switch (when ON) is very small (typically less than 1 V), there is a savings in the consumption of power in the circuit when compared with the current source circuit.

Figure 1:
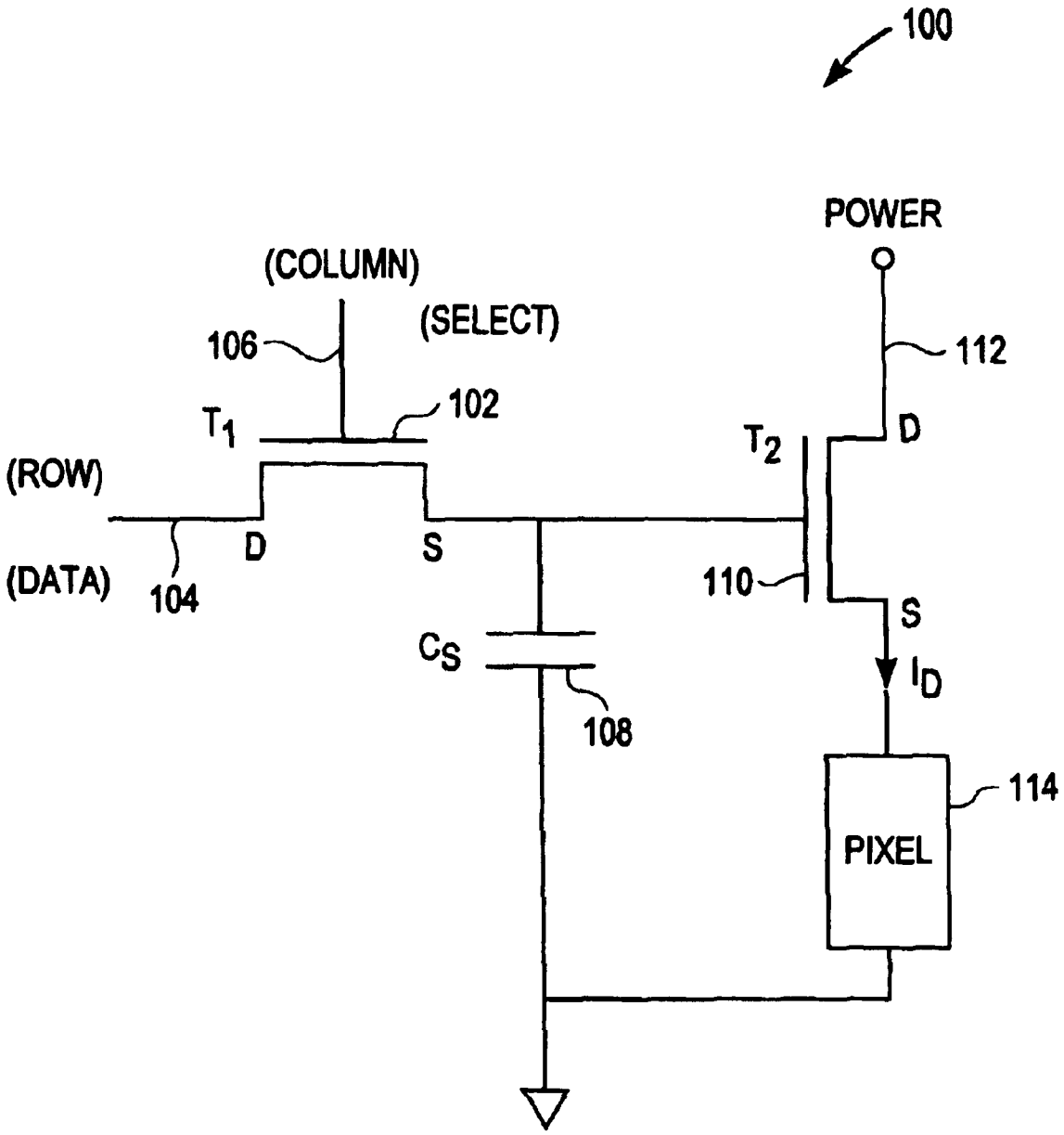
FIG. 1 depicts a TFT driver circuit for an active matrix liquid crystal display as well as one suitable for the purposes of the present invention.
Figure 2:
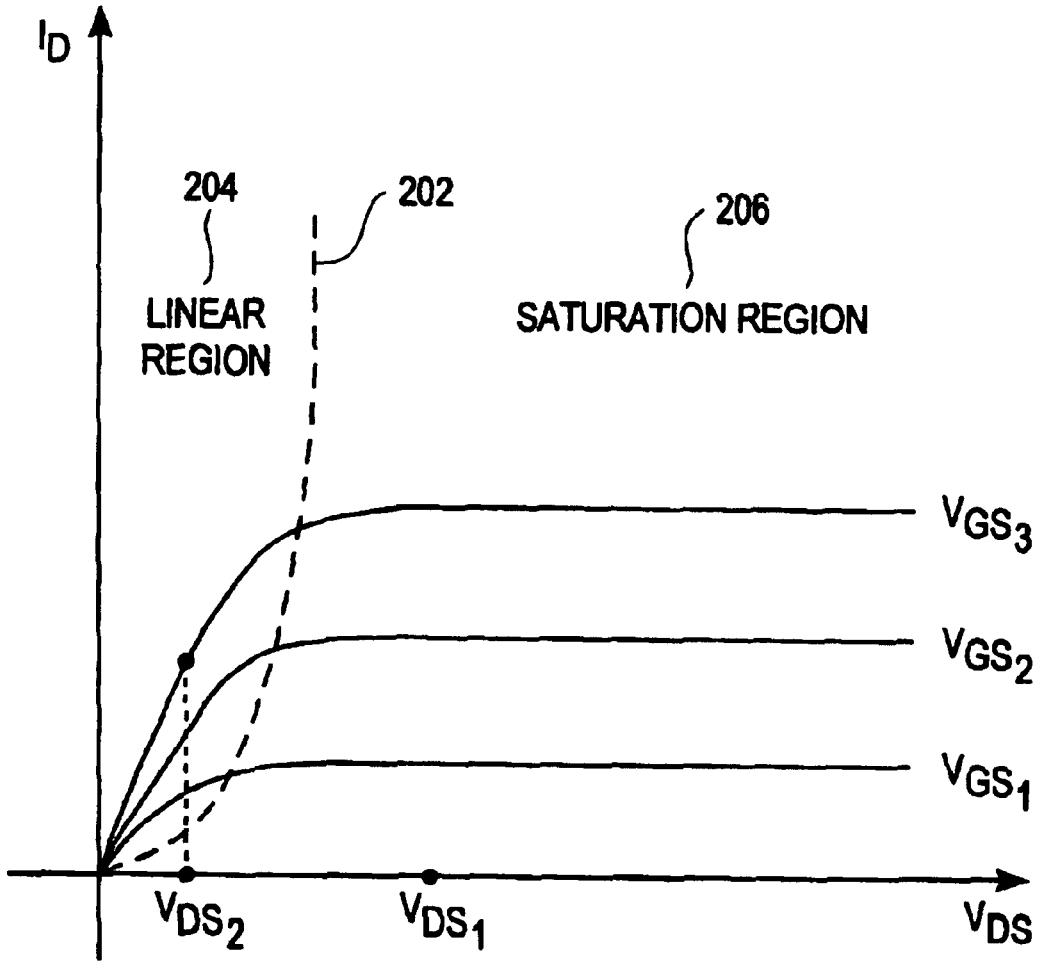
FIG. 2 is a typical operating characteristic curve of a TFT, plotting $I_D$ versus $V_{DS}$.

To achieve voltage-source operation of the circuit shown in FIG. 1, it is desirable to operate T2 in its linear region of operation. Thus, it is desirable to select a correspondingly low $V_{DS2}$ within the linear region. Additionally, in one embodiment, there is a pre-defined voltage $V_{GS3}$ that will be defined as the "turn-on" voltage of the switch T2. It will be noted that $V_{GS3}$ may be higher than the $V_{GS}$ used during operation in the saturation region; but, as no current is drawn from the gate to the source, such a possibly higher voltage should not lead to any increase in the power consumption of the circuit.

To achieve the higher $V_{GS}$ with the circuit of FIG. 1, one embodiment of the present invention is to select the charging capacitor $C_S$ with the appropriate characteristics to supply the requisite voltage to the gate of T2 when selected as ON. Such characteristics would be depend on a number of factors—such as the timing of the raster scan across the entire display, the voltage level of the ROW data, and the like. It is well known in the art how to select a suitable capacitor to deliver the appropriate voltage to the gate of T2. Once selected, T2 would operate in its linear region and T2 would operate as a switch.

As noted above, such a voltage-source driver circuit offers several advantages over the conventional current-source approach. First, as T2 is used as a switch, the transistor is operating in the linear region and $V_{DS}$ is small (less than 1 V). As a result, the pixel power consumption will be equal to $I^*(V_{PIXEL})$. This power consumption is substantially smaller than the current source approach due to the reduced overhead source to drain voltage.

Also, since the TFT is used as a switch, either n-channel or p-channel transistor can be used to drive OLED. It might be desirable to used n-channel devices because of the higher electron mobility. N-channel transistors offer two advantages. First, it reduces the size of the transistor, hence, improving the pixel fill factor. Second, a-Si TFT can be used which is desirable because of its lower manufacturing costs as compared with p-Si.

Additionally, as T2 is operating in its linear region, the transistor drain current is proportional to the threshold voltage—given by $I_D \sim (V_{GS}-V_T)$. Thus, the circuit is less sensitive to any drift in the threshold voltage of the transistor compared to a transistor operating in saturation region when it is used as a current source.

Other embodiments of the present invention include all configurations of multiple transistors (i.e. more than two transistors) that are well known in the art. In such configuration, it is desirable that the transistor that is connected to the pixel element be operated in its linear region, as described above.

Figure 4:
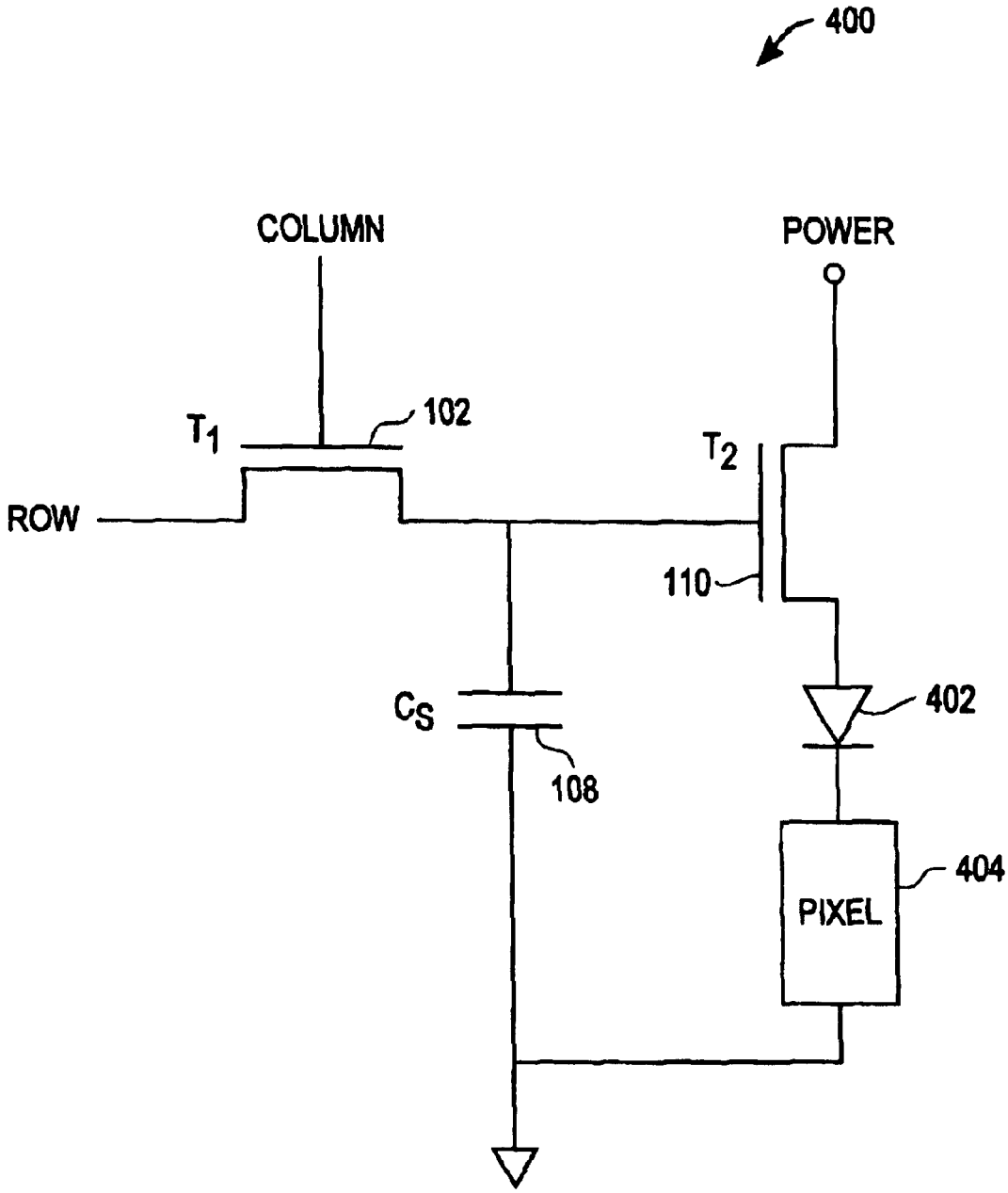
FIG. 4 is another embodiment of the present invention employing a ballast resistor.

Another embodiment of the present invention is shown in FIG. 4. The circuit has the same basic schematic as before in FIG. 1, except that the pixel element is depicted explicitly as an OLED pixel 402 and the addition of ballast resistor 404. It will be appreciated that other pixel elements (other than OLED pixels) may be used in the circuit in keeping with the principles of the present invention—however having a ballast resistor with an OLED pixel might be advantageous.

An OLED pixel element is typically a nonlinear device. In some applications, the current control by voltage may not sufficient. In such case, better current control may be achieved using a ballast resistor in series with the OLED pixel. Typically, the resistance value of the ballast resistor is on the order of a few hundred kohms to a Mohm. The current-voltage linearity of an OLED device may be improved substantially with an addition of a ballast resistor.

Figure 5A:
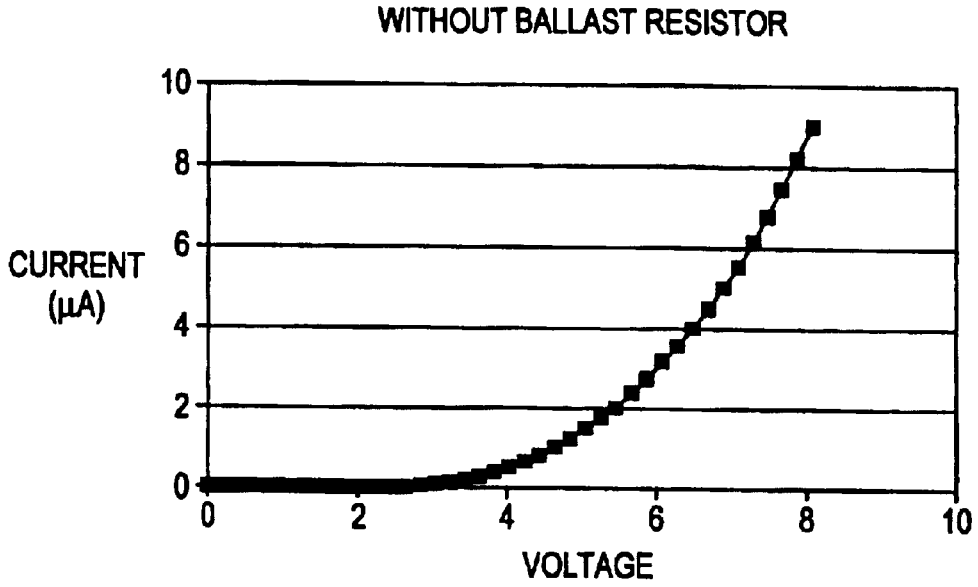
FIGS. 5A–5B show the current-source diagram of the TFT driver circuit as made in accordance with the principles of the present invention, without a ballast resistor and with a ballast resistor respectively.
Figure 5B:
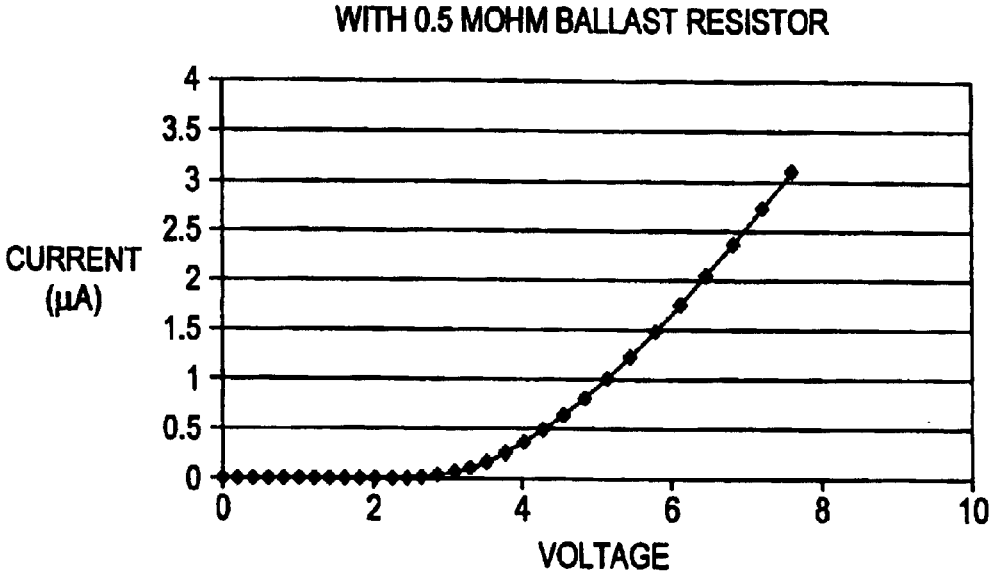

FIGS. 5A and 5B show the current voltage characteristics of a 100 um×100 um pixel without a ballast resistor and with a ballast resistor respectively. Typically, an OLED pixel is operating between 1 $\mu$A and 10 $\mu$A range. As shown in the FIG. 5A, the current voltage curve is nonlinear within the operating range and good current control is difficult to achieve. With an additional of a ballast resistor, the current-voltage linearity can be substantially improved. FIG. 5B shows the current-voltage curve of an OLED pixel with a 0.5 MΩ ballast resistor and the current may more easily be controlled by varying the voltage.

It will be appreciated that the ballast resistor itself may be manufactured in any fashion known in the art. For example, the ballast resistor could be made with amorphous silicon or from polycrystalline silicon. Additionally, the ballast resistor could be made with metal oxide, such as tantalum oxide.

A novel voltage-source driver circuit for an active matrix display has now been disclosed by the foregoing discussion. It will be appreciated that the scope of the present invention should not be limited by the disclosure of any particular embodiment herein. Instead, the proper scope of the present invention includes and contemplates any and all obvious variations of the foregoing.

What is claimed is:

1. A driver circuit for an active matrix display, said driver circuit comprising:

a first transistor, said first transistor comprising a source, a drain and a gate;

a storage capacitor, said storage capacitor comprising a terminal, said terminal connected to one line, said one line comprised of a group of said source and said drain of said first transistor;

a second transistor, said second transistor comprising a source, a drain and gate, wherein said gate is connected to said terminal of said storage transistor;

wherein said drain and said source of said second transistor are connected to one of group, said group comprising a power source and a pixel element respectively; and further wherein storage capacitor is chargeable to sufficiently high voltage to operate said second transistor in its linear region of operation.

2. The driver circuit as recited in claim 1 wherein said first and said second transistors are fabricated with amorphous silicon.

3. The driver circuit as recited in claim 1 wherein said first and said second transistors are fabricated with polycrystalline silicon.

4. The driver circuit as recited in claim 1 wherein said pixel element is an OLED diode.

5. The driver circuit as recited in claim 1 wherein said first transistor and said second transistor is selected among a group, said group comprising the set of n-channel transistors and p-channel transistors.

6. The driver circuit as recited in claim 1 further wherein a sufficiently low voltage between said drain and said source of said second transistor is selected for linear region operation of said second transistor when said sufficiently high voltage supplied by said storage capacitor is applied to said second transistor.

7. A driver circuit for an active matrix display, said driver circuit comprising:

a first transistor, said first transistor comprising a source, a drain and a gate;

a storage capacitor, said storage capacitor comprising a terminal, said terminal connected to one line, said one line comprised of a group of said source and said drain of said first transistor;

a second transistor, said second transistor comprising a source, a drain and gate, wherein said gate is connected to said terminal of said storage transistor;

wherein said drain and said source of said second transistor are connected to one of group, said group comprising a power source and a pixel element respectively;

a ballast resistor connected to said pixel element; and further wherein said storage capacitor is chargeable to sufficiently high voltage to operate said second transistor in its linear region of operation.

8. The driver circuit as recited in claim 7 wherein said first and said second transistors are fabricated with amorphous silicon.

9. The driver circuit as recited in claim 7 wherein said first and said second transistors are fabricated with polycrystalline silicon.

10. The driver circuit as recited in claim 7 wherein said pixel element is an OLED diode.

11. The driver circuit as recited in claim 7 wherein said first transistor and said second transistor is selected among a group, said group comprising the set of n-channel transistors and p-channel transistors.

12. The driver circuit as recited in claim 7 further wherein a sufficiently low voltage between said drain and said source of said second transistor is selected for linear region operation of said second transistor when said sufficiently high voltage supplied by said storage capacitor is applied to said second transistor.

13. The driver circuit as recited in claim 7 wherein said ballast resistor comprises amorphous silicon.

14. The driver circuit as recited in claim 7 wherein said ballast resistor comprises polycrystalline silicon.

15. The driver circuit as recited in claim 7 wherein said ballast resistor comprises metal oxide.

16. The driver circuit as recited in claim 7 wherein said ballast resistor comprises as tantalum oxide.

17. A driver circuit for an active matrix display, said driver circuit comprising:

a storage capacitor, said storage capacitor comprising a terminal;

a transistor, said transistor comprising a source, a drain and gate, wherein said gate is connected to said terminal of said storage transistor;

wherein said drain and said source of said transistor are connected to one of group, said group comprising a power source and a pixel element respectively; and further wherein storage capacitor is chargeable to sufficiently high voltage to operate said transistor in its linear region of operation.

* * * * *